US005816654A

United States Patent [19]

Ellis

[11] Patent Number: 5,816,654

[45] Date of Patent: Oct. 6, 1998

[54] BACK AND LUMBAR SUPPORT AND METHOD

[76] Inventor: Nancy L. Ellis, 7685 Buttonwood Trails, Fulton, Mo. 65251

[21] Appl. No.: 819,904

[22] Filed: Mar. 18, 1997

Related U.S. Application Data

[63] Continuation-in-part of Ser. No. 611,720, Mar. 6, 1996, abandoned.

[51] Int. Cl.[6] ..... A47C 31/11; A47C 7/42

[52] U.S. Cl. ..... 297/284.5; 297/219.1; 297/228.1; 297/229; 297/230.1; 297/230.13

[58] Field of Search ..... 297/284.5, 219.1, 297/228.1, 229, 230.1, 230.11, 230.12, 230.13, 230.14

[56] References Cited

U.S. PATENT DOCUMENTS

| | | | |
|---|---|---|---|
| 3,220,768 | 11/1965 | Bird | 297/229 |
| 3,504,941 | 4/1970 | Gerard | 297/219.1 X |
| 3,515,430 | 6/1970 | Nelson . | |
| 3,813,148 | 5/1974 | Kraus | 297/284.5 X |
| 4,036,524 | 7/1977 | Takamatsu | 297/219.1 X |
| 4,232,898 | 11/1980 | Bodrero | 297/228.1 |
| 4,500,102 | 2/1985 | Haury et al. | 297/229 X |
| 4,536,028 | 8/1985 | Jones | 297/229 |
| 4,597,605 | 7/1986 | Gilbert | 297/219.1 |
| 4,669,779 | 6/1987 | Kaganas et al. | 297/229 |
| 4,676,376 | 6/1987 | Kelswetter | 297/229 |
| 4,693,511 | 9/1987 | Seltzer et al. | 297/219.1 |
| 4,725,094 | 2/1988 | Greer | 297/229 |
| 4,790,592 | 12/1988 | Busso et al. | 297/229 X |
| 4,828,320 | 5/1989 | Saiger | 297/229 |
| 4,862,536 | 9/1989 | Pruit | 297/284.5 |
| 4,877,288 | 10/1989 | Lee | 297/229 |
| 5,101,811 | 4/1992 | Brunswick | 297/284.5 X |
| 5,234,252 | 8/1993 | Wallach | 297/228.1 X |
| 5,265,933 | 11/1993 | Croshaw | 297/228.1 |
| 5,275,463 | 1/1994 | Rocha | 297/229 |
| 5,281,002 | 1/1994 | Dauphin | 297/219.1 X |
| 5,509,155 | 4/1996 | Zigarac et al. | 297/219.1 X |
| 5,551,752 | 9/1996 | Lovegrove et al. | 297/284.5 |
| 5,573,302 | 11/1996 | Harrison et al. | 297/284.5 X |
| 5,618,082 | 4/1997 | Jochmich | 297/229 |
| 5,626,397 | 5/1997 | Reid | 297/229 X |

FOREIGN PATENT DOCUMENTS

| | | | |
|---|---|---|---|
| 1457481 | 11/1966 | France | 297/229 |
| 1464782 | 1/1967 | France | 297/219.1 |
| 2856366 | 2/1980 | Germany | 297/284.5 |
| 1143275 | 2/1969 | United Kingdom | 297/219.1 |
| 1316564 | 5/1973 | United Kingdom | 297/219.1 |
| 2215198 | 9/1989 | United Kingdom | 297/228.1 |
| 2280105 | 1/1995 | United Kingdom | 297/230.1 |
| 9503192 | 2/1995 | WIPO | 297/228.1 |

*Primary Examiner*—Peter M. Cuomo
*Assistant Examiner*—Rodney B. White
*Attorney, Agent, or Firm*—Polster, Lieder Woodruff & Lucchesi

[57] ABSTRACT

An adjustable human back and lumbar support for use with a chair having an upwardly extending back and a defined seat. The support includes a strip of flexible sheet material with a pocket for mounting an upper end of the strip at an upper part of the chair back to hold the strip against downward movement and webbing secured lengthwise of the strip to inhibit elongation of the strip. The strip is of a length to extend along and over the seat of the chair but so arranged that a back part of the strip is spaced forwardly, clear of the back of the chair along its length from the pocket to the seat portion. The back of a person sitting on the support is supported by the strip between the seat and the upper part of the back, rather than by the chair back itself, from which the strip is spaced. Hips and lower back of the sitter are urged to roll forwardly.

7 Claims, 4 Drawing Sheets

BACK AND LUMBAR SUPPORT AND METHOD

CROSS-REFERENCE TO RELATED APPLICATIONS

This application is a continuation in part of U.S. Ser. No. 08/611,720 Mar. 6, 1996 now abandoned, the disclosure of which is incorporated herein by reference.

STATEMENT REGARDING FEDERALLY SPONSORED RESEARCH OR DEVELOPMENT

Not Applicable.

BACKGROUND OF THE INVENTION

Many tasks, such as typing, working at a computer, operating an industrial sewing machine, and the like, require sitting for long periods of time, and this leads to fatigue and back pain. Sitting for prolonged times at meetings and gatherings on folding chairs, also leads to discomfort. Persons confined to wheelchairs often suffer from back pain.

One of the objects of this invention is to provide a support for the back and lumbar regions that is simple and adapted to use with existing chairs or seats, including automobile and truck seats and wheelchairs, all of which are embraced within the scope of the term "chair" as used herein.

Another object is to provide a method of supporting the human back and lumbar region on a chair in a more comfortable posture than is possible with most chairs, particularly straight backed chairs with a defined seat.

Other objects will become apparent to those skilled in the art in the light of the following description and accompanying drawing.

BRIEF SUMMARY OF THE INVENTION

In accordance with this invention, generally stated, an adjustable human back and lumbar support for use with a chair having an upwardly extending back and a defined seat is provided, which comprises a strip of flexible sheet material, means for mounting positively an upper end of the strip at an upper portion of the back of the chair against downward movement of the strip, and means for inhibiting elongation of the strip. The strip is of a length to extend along and over the seat of the chair sufficiently far to be engaged by the buttocks of a person seated on the seat, with the strip tending in outwardly spaced relation to the back in the direction of the seat. The use of the strip provides a method of supporting the back and lumbar region which includes sitting on a part of the strip along the seat while maintaining the strip spaced from the back of the chair below the mounted upper part of the strip.

DETAILED DESCRIPTION OF THE INVENTION

Figure 1:
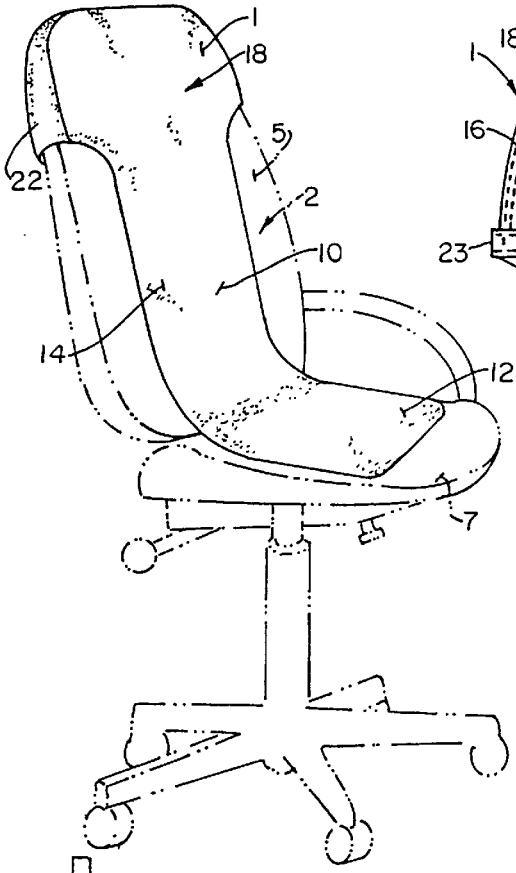
FIG. 1 is a view in perspective of a chair equipped with one embodiment of support of this invention.
Figure 1A:
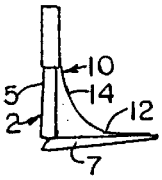
FIG. 1A is a somewhat schematic view, in side elevation, showing the support as it is intended to be used.
Figure 2:
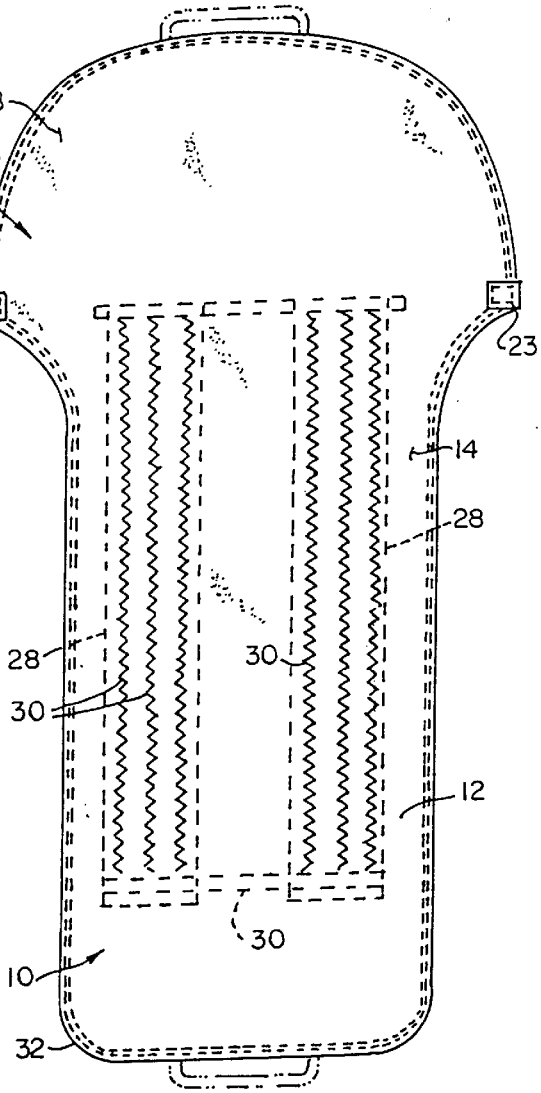
FIG. 2 is a view in front elevation of the support removed from the chair.
Figure 3:
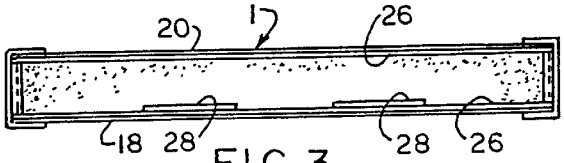
FIG. 3 is a bottom plan view of the support as shown in FIG. 2.
Figure 4:
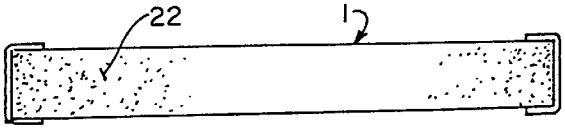
FIG. 4 is a view top plan view.
Figure 5:
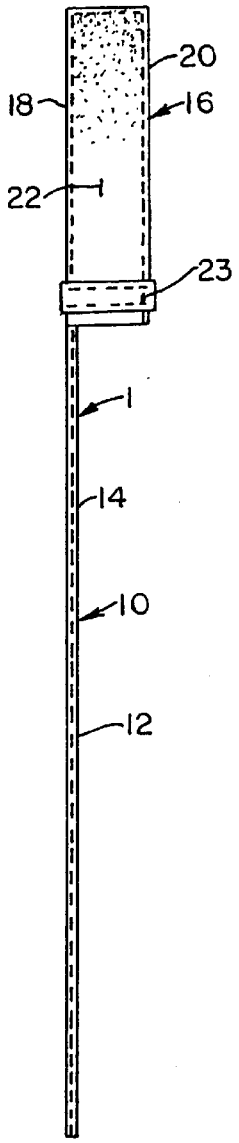
FIG. 5 is a view side elevation.
Figure 6:
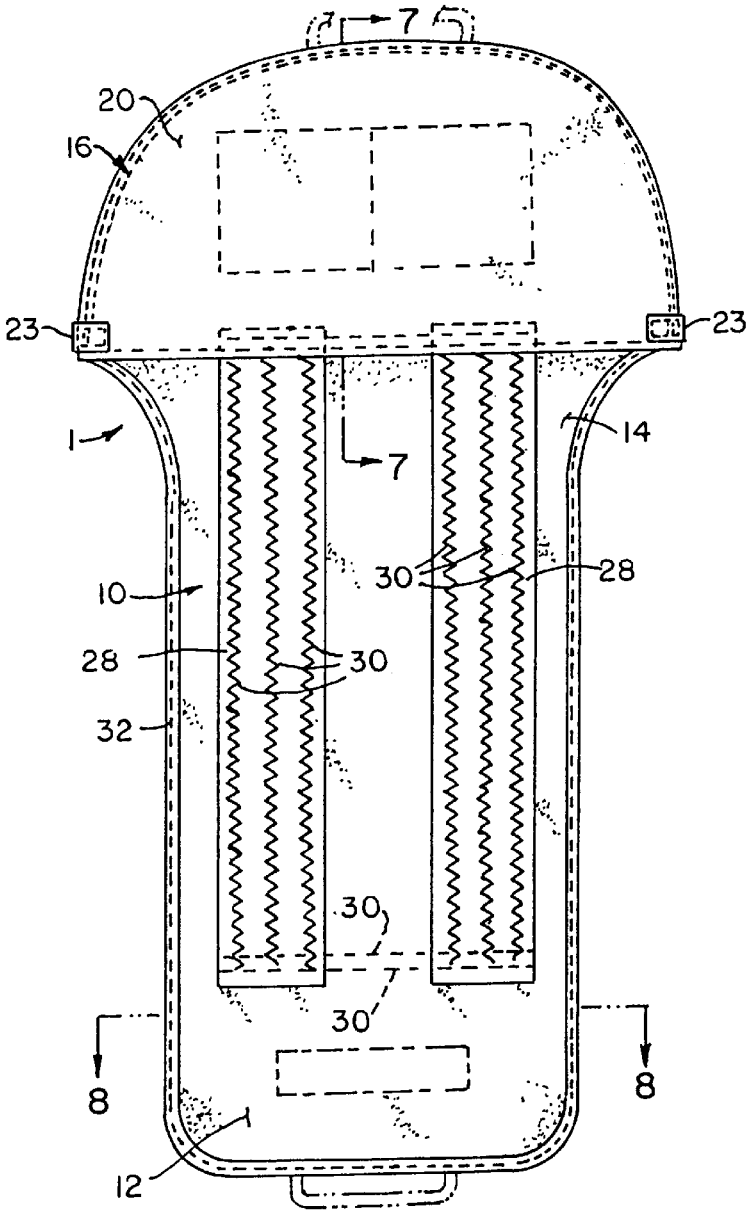
FIG. 6 is a view in rear elevation.
Figure 7:
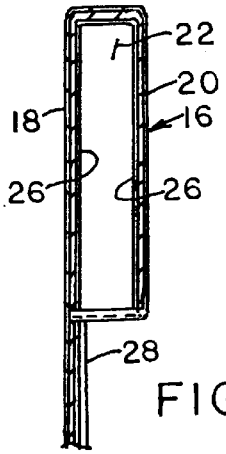
FIG. 7 is a sectional view taken along the line 7—7 of FIG. 6.
Figure 8:
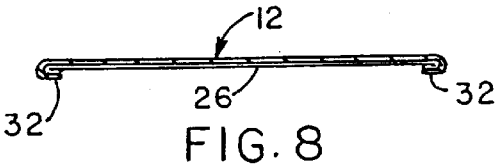
FIG. 8 is a view taken along the line 8—8 of FIG. 6.

Referring now to the drawing for one illustrative embodiment of this invention, reference numeral 1 indicates a support which, in FIGS. 1 and 1A, is shown as mounted on a chair 2 with a back 5 and a defined seat 7. The seat 7 has a front or forward area 8, spaced from the chair back 5. By defined seat, is meant a seat the dimensions and outline of which are clearly defined, as distinguished, for example, from certain types of canvas lawn chairs, in which a single strip forms a back and seat, neither of which is defined until someone sits in the chair, and then they are defined by the size and weight of the person sitting.

Support 1 includes a strip 10, with a seat area 12 and a back area 14. A mounting pocket 16, in this embodiment, has a front panel 18, one piece with the back area 14 of the strip, a rear panel 20 and a bridging side panel 22 extending between the front panel 18 and the rear panel 20, connecting the two. In this embodiment reinforcing tapes 23 extending along the side panel on both sides of the strip and the front and rear panels, serve to prevent or inhibit splitting along the lower edge of the side panel.

Preferably the strip 10 is made of brushed nylon with a foam backing 26. The foam backing can be a thin sheet of polyurethane, secured to the brushed nylon, or any other suitable material. It serves both to give body and at least a slight resilience to the nylon, and also to keep the strip in place on the chair seat. Furthermore, it will hold to a hook portion of a hook and loop fastener, e.g. Velcro.

Strips of webbing 28 of substantial width are fastened to the back of the strip 10 by means of stitching 30. These strips of webbing serve to prevent or inhibit stretching of the strip.

The strip, and the lower edges of the side panel and rear panel can be hemmed, as shown in 32.

When a mounting pocket 16 is used, it can be made to a size and shape to accommodate any chair back. In an automotive seat, for example, it can be shaped and sized to receive a head rest. Alternatively, the strip can be secured at its upper end by Velcro (hook and loop type) strips, or any other suitable means for positively holding the upper end of the strip against movement lengthwise of the strip with respect to the held upper end.

As can be appreciated, handles can be attached to the top part of the pocket and to the lower edge of the seat area of the strip to facilitate carrying and to permit the strip to be used as a carrier. Pouches to receive books or any other article likely to be of use in meetings and the like can be attached to the back panel permanently or, with the use of Velcro or the like, temporarily.

Figure 10:
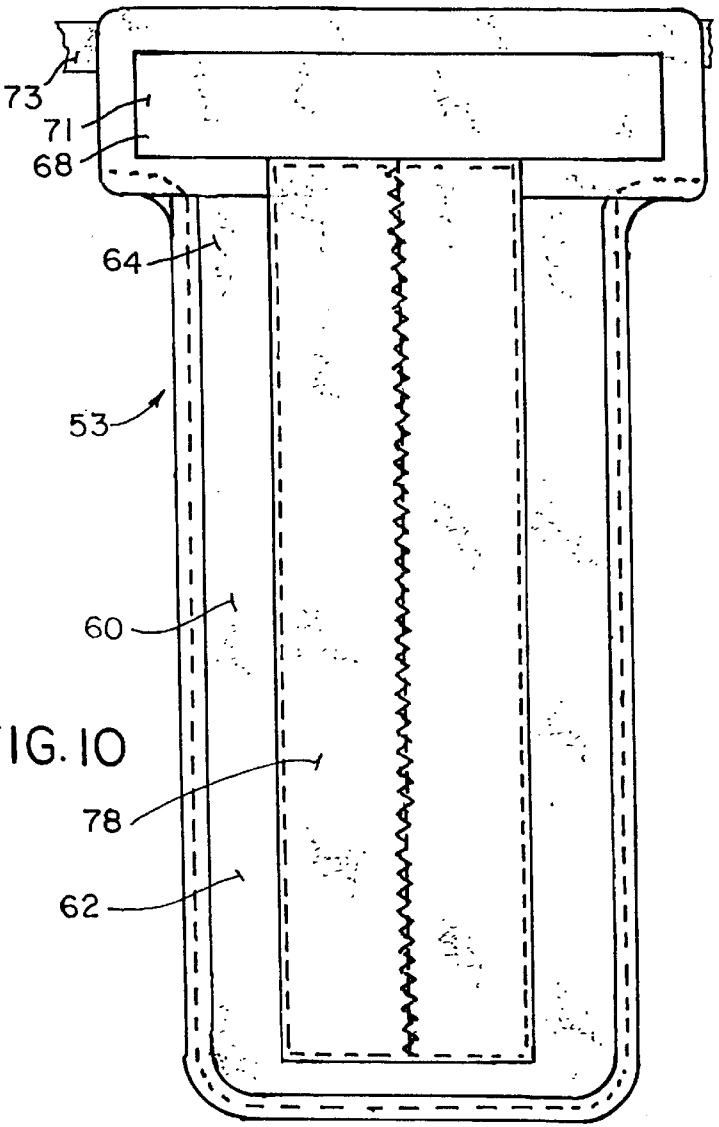
FIG. 10 is a view in front elevation of the support shown in FIG. 9.
Figure 9:
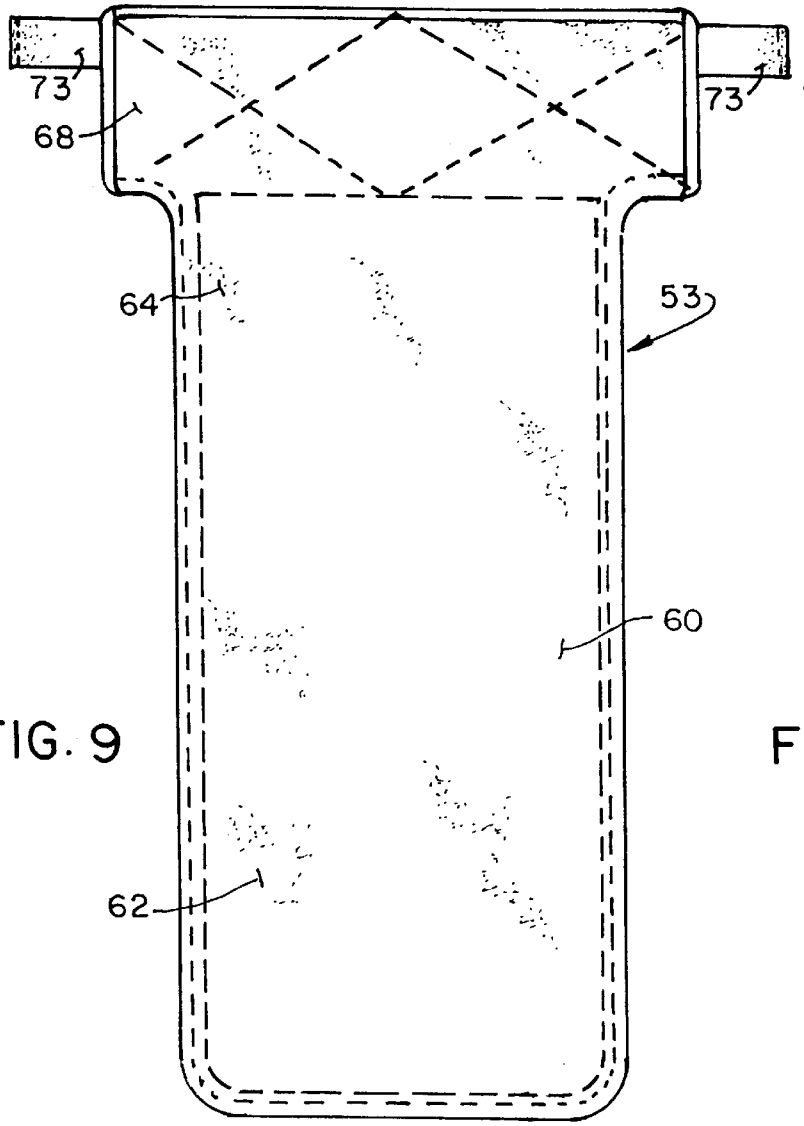
FIG. 9 is a view in rear elevation of another embodiment of support of this invention.
Figure 11:
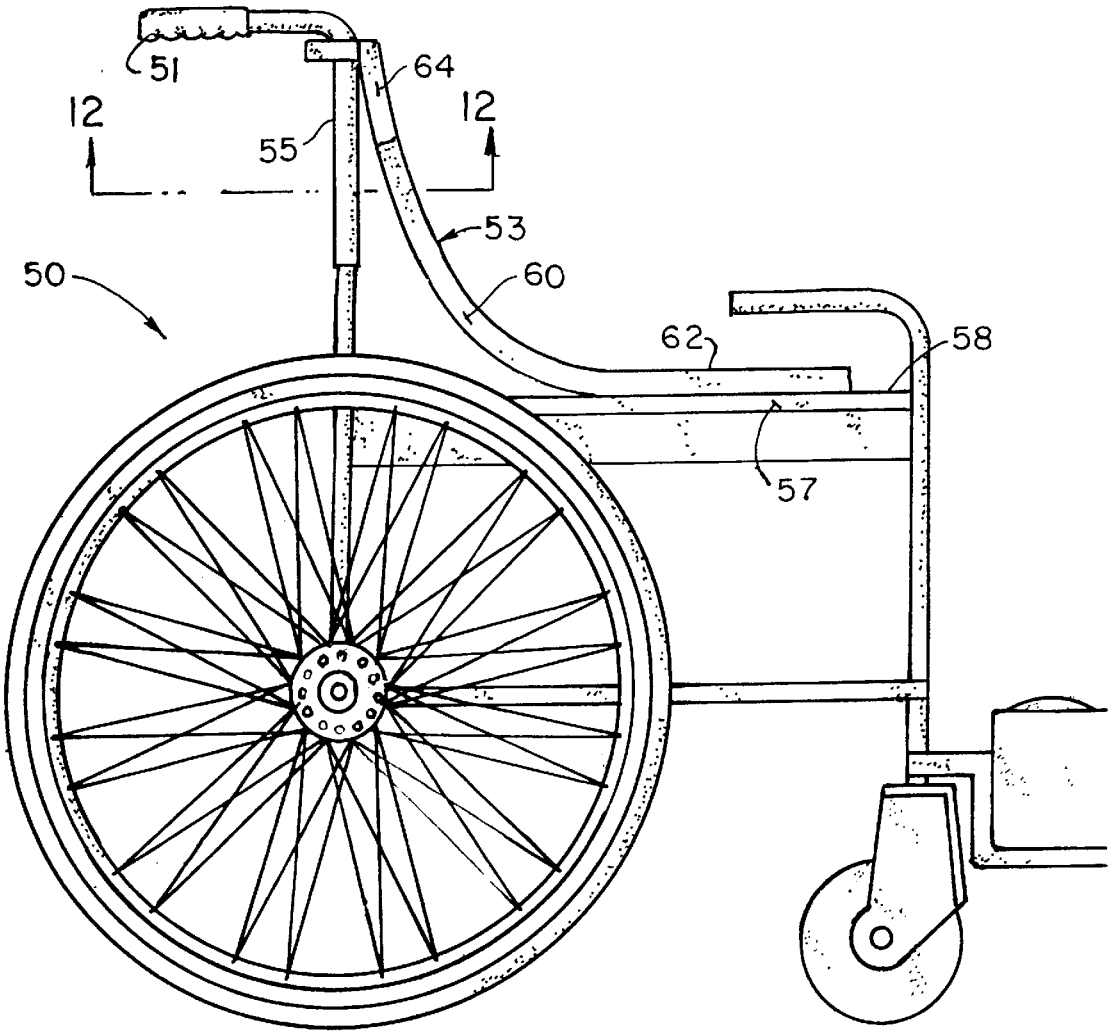
FIG. 11 is a view in side elevation of a wheelchair equipped with the embodiment of support of this invention shown in FIGS. 9 and 10.
Figure 12:
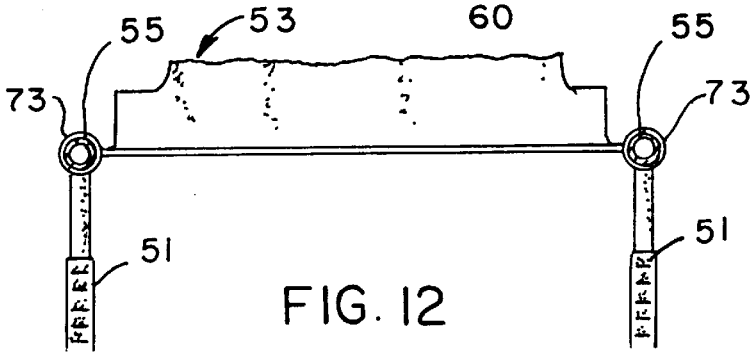
FIG. 12 is a view along the line 12—12 of FIG. 11, partly in section and partly fragmentary.

Referring now to FIGS. 9–11 for a second illustrative embodiment, reference numeral 50 indicates a wheelchair, with handles 51, a back 55 and a seat 57, the seat 57 having a front area 58. A support 53 mounted on the wheelchair is made up of a strip 60 with a seat area 62 and a back area 64. At the upper end of the back area, the strip has a laterally extending, reinforced head piece 68 which extends beyond the side edges of the rest of the strip 60. Handle loops 73 are attached securely to the outer edges of the head piece 68. The handle loops 73 are mounted around the handles 51, as indicated in FIGS. 11 and 12. A broad length of webbing 78 extends from the head piece down the center of the back area of the strip 60, the webbing being wide enough to span most of the width of the back of a person sitting in the wheelchair.

As shown particularly in FIGS. 1A, and 11, in use, the strip is mounted on or at the upper end of the chair back or head rest, or, in the case of the wheelchair illustrated in FIG. 11, on or around handles, positively against movement in the longitudinal direction of the strip. In the embodiment shown, the strip is mounted by means of the pocket, and the seat part of the strip is placed on the seat of the chair, with the back part 14 of the strip spaced from the back of the chair or from the plane in which the back would lie if there were a full back (some chairs having only a part of a back, then a substantial space between that part and the seat), and then the sitter sits on the seat part 12 of the strip, while maintaining the strip in its forward tending position, clear of the back of the chair from the mounted end of the strip to the forward portion of the seat.

It has been found that by using the support of this invention in the way that has been indicated, the back of the person using the chair on which the support is mounted experiences less back and lumbar region stress than when the support is not used. Although the theory of its operation is not a part of the invention, it is believed that when used as described, the support brings the sacrum forward, thus freeing the pressure on the lumbar and sacral nerves, reduces pressure on the spine and tailbone, creates a soothing stretch of the lower back, and promotes better posture and muscle tone.

Numerous variations in the construction of the support of this invention, within the scope of the appended claims, will occur to those skilled in the art in the light of the foregoing disclosure. Merely by way of illustration, the webs can be made of heavy Nylon, canvas or other strong, substantially non-extensible woven material. The webs can be made as broad as the back area of the strip or even made as a layer of material laminated or otherwise incorporated into the strip. When used in an automobile or other vehicle having a head rest, the pocket or other mounting means can be sized to be positioned on or around the head rest. The mounting means can take the shape of a skeletal framework of straps or webs. If brushed Nylon strips, sandwiching between them foamed material are used, or another smoothe-surfaced backing, a strip of non-sliding material can be mounted on the rear surface of the seat part of the strip, to inhibit sliding of the strip over the seat of the chair. Several other variations have been suggested above, and these are merely illustrative.

I claim:

1. In combination with a chair having an upwardly extending back and a defined seat having a front area spaced from said back, an adjustable human back and lumbar support comprising a strip of flexible sheet material; means mounting an upper end of said strip positively at an upper portion of said back against downward movement of said strip, and means inhibiting elongation of said strip, said strip extending along and over said seat far enough to be engaged by a buttocks of a person seated on said seat, said strip tending from said mounting means at the upper end of said strip in a continuously forwardly and outwardly spaced relation to and entirely clear of contact with said back at any point from said mounting means to said seat front area, whereby a back of said person is supported by said strip between said seat front area and the mounted upper end of said strip.

2. The combination of claim 1 wherein said strip is made of cloth and said means for inhibiting elongation comprise webs sewn to the back of said strip in a lengthwise direction.

3. The combination of claim 1 wherein said means for mounting said strip comprise an open-bottomed pocket sized to fit over a top of a back of said chair.

4. The combination of claim 1 wherein said strip is made of brushed nylon with a thin backing of foamed polymer.

5. The combination of claim 1 wherein said chair is a wheelchair having handles, and said means for mounting comprise loops secured to said strip and extending around said handles.

6. The method of supporting the human and lumbar region of a person sitting on a chair with a back and a defined seat, comprising mounting at an upper portion of said chair back an upper part of an elongated, generally rectangular strip of flexible material positively against movement lengthwise of said strip with respect to said upper part, extending said strip in a continuously forwardly and outwardly spaced relation to and entirely clear of contact with said back at any point from said mounted upper part to said seat and extending said strip along a forward area of said seat, and sitting on a part of said strip along said seat while maintaining said strip spaced from said back continuously below said mounted upper part of said strip, and inhibiting said strip against elongation.

7. The method of claim 6 wherein the chair is a wheelchair with handles, the strip has attached to it loops positioned to be mounted on the handles, and the method includes mounting said loops on said handles.

* * * * *